United States Patent [19]

Nye

[11] 4,346,677

[45] Aug. 31, 1982

[54] COMBUSTION ENGINE WITH SUBSTANTIALLY CONSTANT COMPRESSION

[76] Inventor: Norman H. Nye, 1348 Highbridge Rd., Cuyahoga Falls, Ohio 44223

[21] Appl. No.: 183,251

[22] Filed: Sep. 2, 1980

[51] Int. Cl.[3] ..... F02B 75/26

[52] U.S. Cl. ..... 123/54 B; 123/18 A; 123/78 E

[58] Field of Search ..... 123/18, 54 R, 54 B, 123/48 R, 48 B, 78 R, 78 E

[56] References Cited

U.S. PATENT DOCUMENTS

| | | | |
|---|---|---|---|
| 1,335,947 | 4/1920 | Welke | 123/54 R |
| 2,433,639 | 12/1947 | Woodruff et al. | 123/48 B |
| 2,589,958 | 3/1952 | Petit | 123/48 B |
| 2,873,611 | 2/1959 | Biermann | 123/48 B |
| 2,904,023 | 9/1959 | Roth | 123/54 R |
| 3,910,238 | 10/1975 | James | 123/18 R |
| 4,131,094 | 12/1978 | Crise | 123/78 E |

*Primary Examiner*—Craig R. Feinberg

*Attorney, Agent, or Firm*—Oldham, Oldham, Hudak & Weber Co.

[57] ABSTRACT

A variable length stroke piston is provided in an internal combustion engine having an engine block means including a toroidal shaped cylinder, a piston positioned in the cylinder for arcuate reciprocation therein, a piston rod means pivotally positioning the piston for movement about the center axis of the toroid defining the cylinder, a regulatory shaft positioned parallel to a crankshaft and with a connector link extending therefrom, articulated link means pivotally interconnecting the piston rod to the engine connecting rod and operatively connecting to the regulatory shaft, and means operatively connect the regulatory shaft to the accelerator controlling the engine to rotate the regulatory shaft through a controlled arc with changes in the setting of the accelerator and reduce the length of piston stroke with reduced fuel supply to the engine to maintain substantially uniform compression in the cylinder at all times.

6 Claims, 7 Drawing Figures

$$\text{COMPRESSION RATIO} = \frac{\text{DISPLACEMENT} + \text{HEAD SPACE}}{\text{HEAD SPACE}}$$

COMBUSTION ENGINE WITH SUBSTANTIALLY CONSTANT COMPRESSION

BACKGROUND ART

Heretofore, there have been various types of internal combustion engines designed and some of these engines have had variable displacement pistons provided therein, utilizing an articulated connecting rod linkage to vary the stroke of the engine piston in accordance with engine operating conditions and U.S. Pat. No. 4,133,094 shows a combustion engine of that type. Yet another type of a variable displacement reciprocating piston machine is shown in U.S. Pat. No. 4,112,826 which discloses correlating and controlling motion in two associated pistons simultaneously. The compression ratio of the internal combustion engine of U.S. Pat. No. 4,092,957 is controlled by providing two opposed pistons acting in a cylinder, the pistons being connected by a rocker beam to a crankshaft. Simple links and levers joined together by pin joints form the control for a variable stroke piston engine in U.S. Pat. No. 2,909,163 and a similar structure is present in the variable compression ratio engine of U.S. Pat. No. 2,909,164.

The foregoing patents are representative of previously proposed and patented structures in the field of endeavoring to provide a substantially constant compression, variable stroke piston, internal combustion engine.

While it has been known that substantial improvement in part-load efficiencies can be made by increasing the compression ratio as the engine is throttled down to lower speeds, yet it has been very difficult, if not impossible, to provide any efficient, practical type of an internal combustion engine, that obtains a desirable, substantially constant compression ratio at different operating speeds.

The foregoing types of engines have, in general, had either very complicated mechanisms involved in their design, or else the variability of the stroke has been quite limited.

DISCLOSURE OF INVENTION

The general object of the invention is to provide an efficient, variable stroke, substantially constant compression internal combustion piston engine, and to provide the same at a reasonable cost.

Another object of the invention is to provide an internal combustion engine which has toroidal shaped cylinders provided therein, and wherein the friction of the pistons moving axially of the cylinders have minimum or no friction with the cylinder walls; a minimum of friction existing on piston rings sealing the cylinder in the piston cylinder.

Another object of the invention is to provide a variable stroke, substantially constant compression internal combustion engine, wherein sturdy connecting links connect the piston to the crankshaft and a control means can vary the compression ratio and stroke length of the piston in its cylinder over a wide range under different operating conditions for the engine.

Other objects of the invention are to reduce piston friction in an internal combustion engine; to provide an internal combustion engine with an arcuately-shaped cylinder and a pivotally-positioned piston centered for rotation about the center of the arc of the combustion cylinder; to reduce piston friction by having only the piston rings of the piston ring-piston assembly engage the cylinder walls; and to provide a reduced length piston for use in combustion engines.

The foregoing objects and advantages of the invention will be made more apparent as the specification proceeds.

Attention now is particularly directed to the accompanying drawings, wherein.

When referring to corresponding numbers shown in the drawings and referred to in the specification, corresponding numerals are used to facilitate comparison therebetween.

Figure 1:
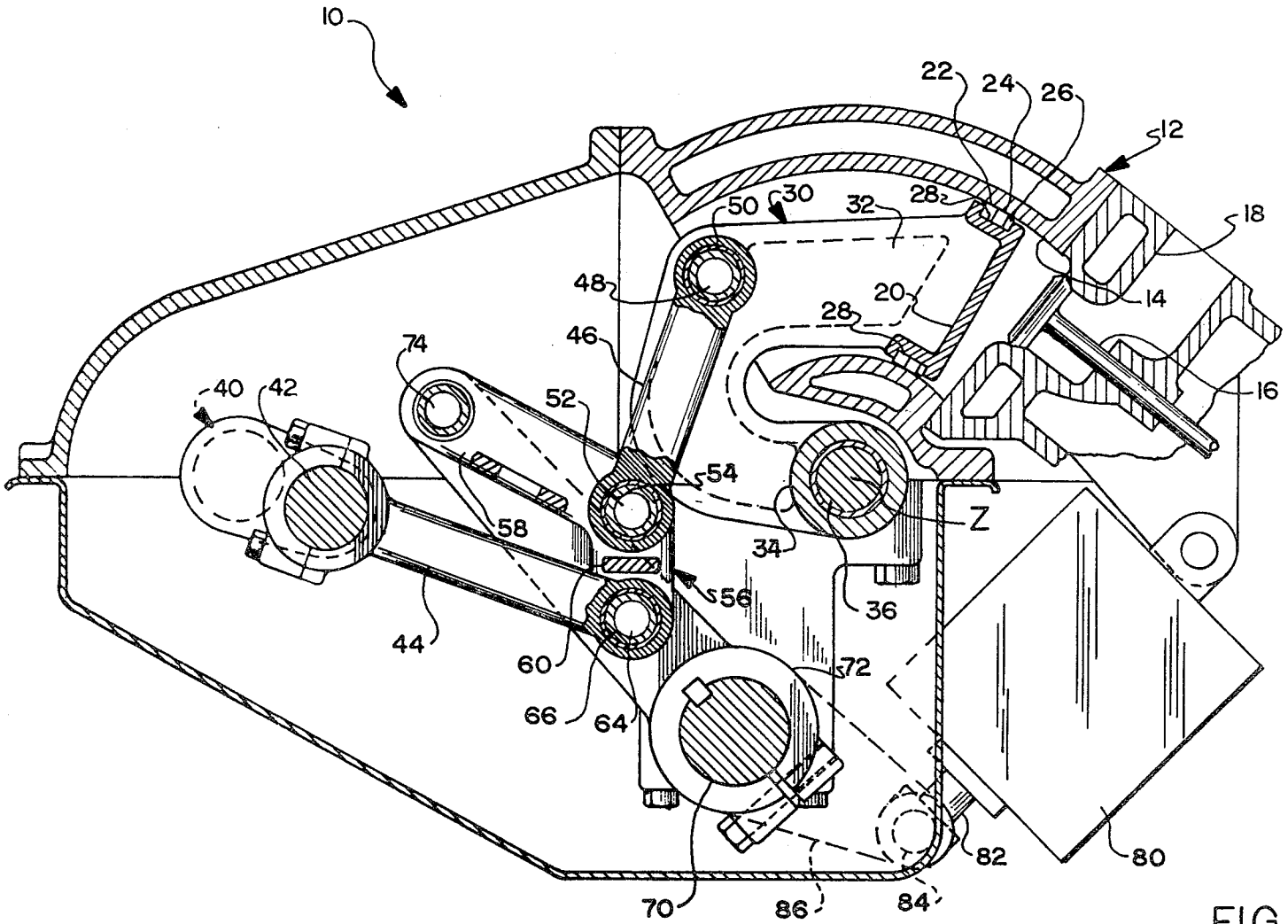
FIG. 1 is a vertical cross-sectional view of an internal combustion engine embodying the principles of the invention with the piston operating through a full stroke and being shown at the top of its stroke.

Particular attention is now directed to the details of the structure shown in the drawings, and a vertical section of an internal combustion engine indicated as a whole by the numeral 10 as shown in FIG. 1 and the operative positions and action of the piston and associated means for different portions of various power output operating cycles are indicated in the various drawings. This engine 10 has a conventional engine block means or member 12 of any suitable construction provided therefor, and a cylinder 14 is provided in this engine block 12. The cylinder 14 is shown to be of arcuate or toroidal shape, and the axis of this toroid shape of the cylinder 14 is at the center Z shown in FIG. 1 of the drawings. The engine 10 has any suitable known type of fuel supply connected thereto and Figs. of the drawings show a conventional valve 16 that controls flow of fuel through an inlet bore 18 to the cylinder 14. Any known means can be associated with this valve and inlet bore for supply of combustion material thereto and a suitable exhaust valve (not shown) is likewise provided in communication with the cylinder 14.

A short length piston 20 is operatively positioned in the cylinder 14 for reciprocation therein and this piston has, preferably, a plurality of piston rings 22, 24, and 26, operatively positioned in a peripherally-recessed wall 28 of the piston 20. Usually, these rings are designed so that rings 22 and 24 spring outward in the cylinder, while ring 26 springs inwardly in the cylinder. These rings can be retained in position in any known manner and provide sliding engagement between the inner walls of the cylinder 14 and the outer surfaces of the rings to seal the piston in its combustion chamber.

Naturally any known ignition means, if required, are provided for the combustion chamber formed by the cylinder 14 and piston 20.

As a further feature of the present invention, the piston 20 is operatively positioned in the cylinder 14 by a roughly U-shaped piston rod 30. This piston rod is formed from two parallel side plates 32 that are suitably bonded to the inner surface of the piston 20 and which extend to an end hub 34 at an opposite end of the side plates from the piston 20. This hub 34 is suitably journaled on a positioning shaft 36, the center axis of which extends through the center Z of radius for the toroidal shape of the cylinder 14. Such shaft 36 obviously is positioned in any desired manner on the engine block and positions the piston and piston rod for arcuate movement in the engine.

Output power from the engine 10 is delivered to a conventional crankshaft 40, one offset arm 42 of which is shown in the drawings. A relatively conventional connecting rod 44 connects to this offset arm 42 of the crankshaft for delivering power thereto and producing the output rotational power delivered by the engine 10.

Obviously any desired number of cylinders as required are provided in the engine 10 and individual means in each cylinder would connect the operative pistons to the corresponding portions of the crankshaft 40 for the engine.

The present invention not only has reduced friction by the novel construction of the piston 20 and cylinder 14 and associated means, but substantially constant compression is obtained in the engine 10 by an unusual articulated linkage that connects the piston rod 30 to the connecting rod 44. These connecting means comprise a link 46 that rotatably connects at one end to a piston rod shaft 48 extending between the side plates 32 of the piston rod 30. Any suitable bearing member 50 journals one end of the coupling link 46 on this piston rod shaft 48. It should be noted that the piston rod shaft 48 has its center axis positioned within the confines of the cylinder 14 at the upper end of the stroke of the piston in the engine. The opposite end of this coupling link 46 is journaled on a shaft 52 by a conventional bearing 54, which shaft is secured to and carried by a more or less L-shaped connector bar 56 that is formed from a pair of side plates 58. These side plates 58 have any suitable reinforcing members 60 and 62 extending therebetween to reinforce and strengthen the connector 56 but to enable several shafts or links to be operably connected thereto. One end of this connector means 56 operatively and pivotally connects to the free end of the connecting rod 44 in a conventional manner as by means of a connector shaft 64 and associated bearing 66. Thus, the power output from the piston is transmitted by the linkage means shown to the crank shaft 40 for power supply thereto.

Figure 2:
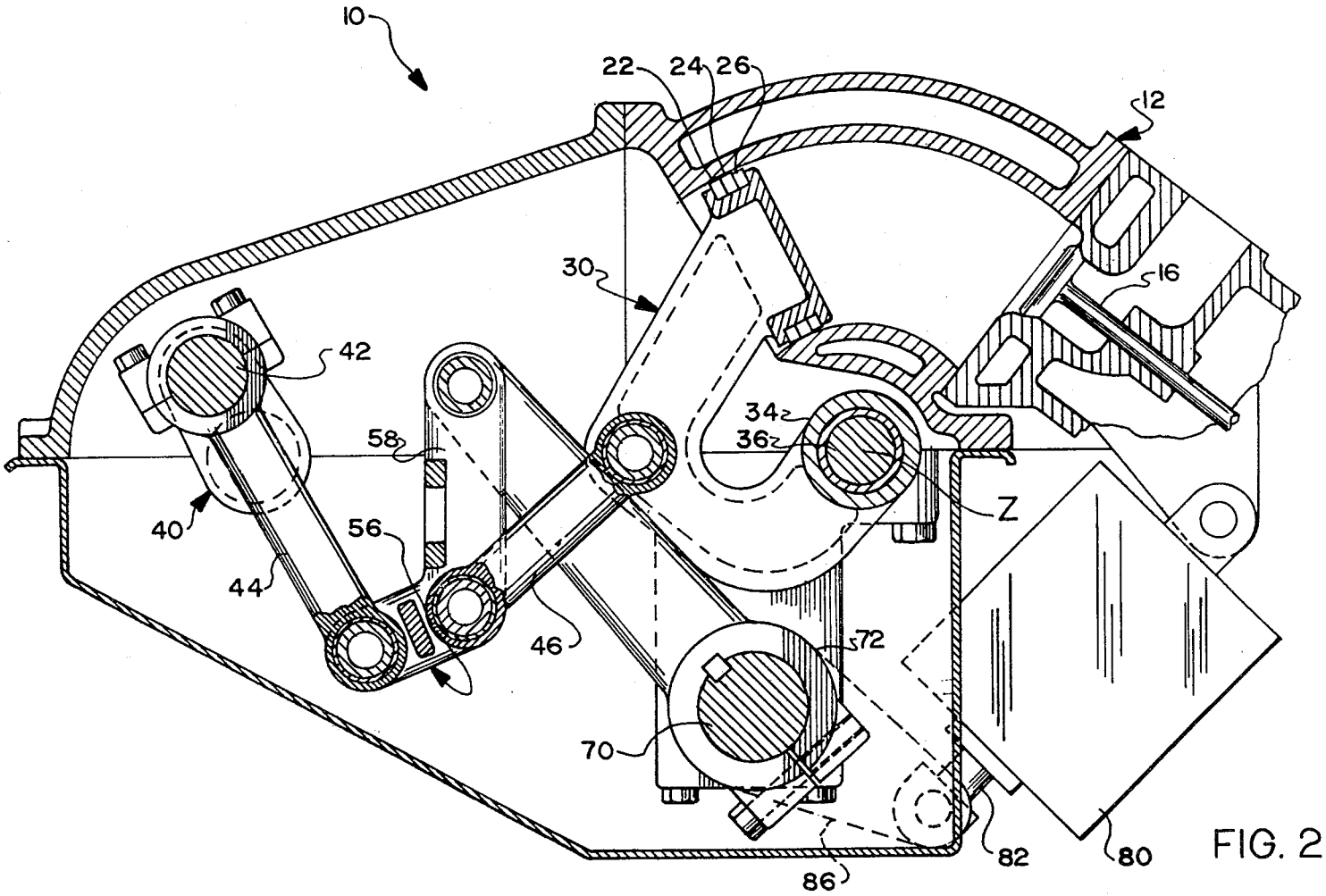
FIG. 2 is a sectional view, like FIG. 1, but showing the piston and associated means at the bottom of the piston stroke.
Figure 3:
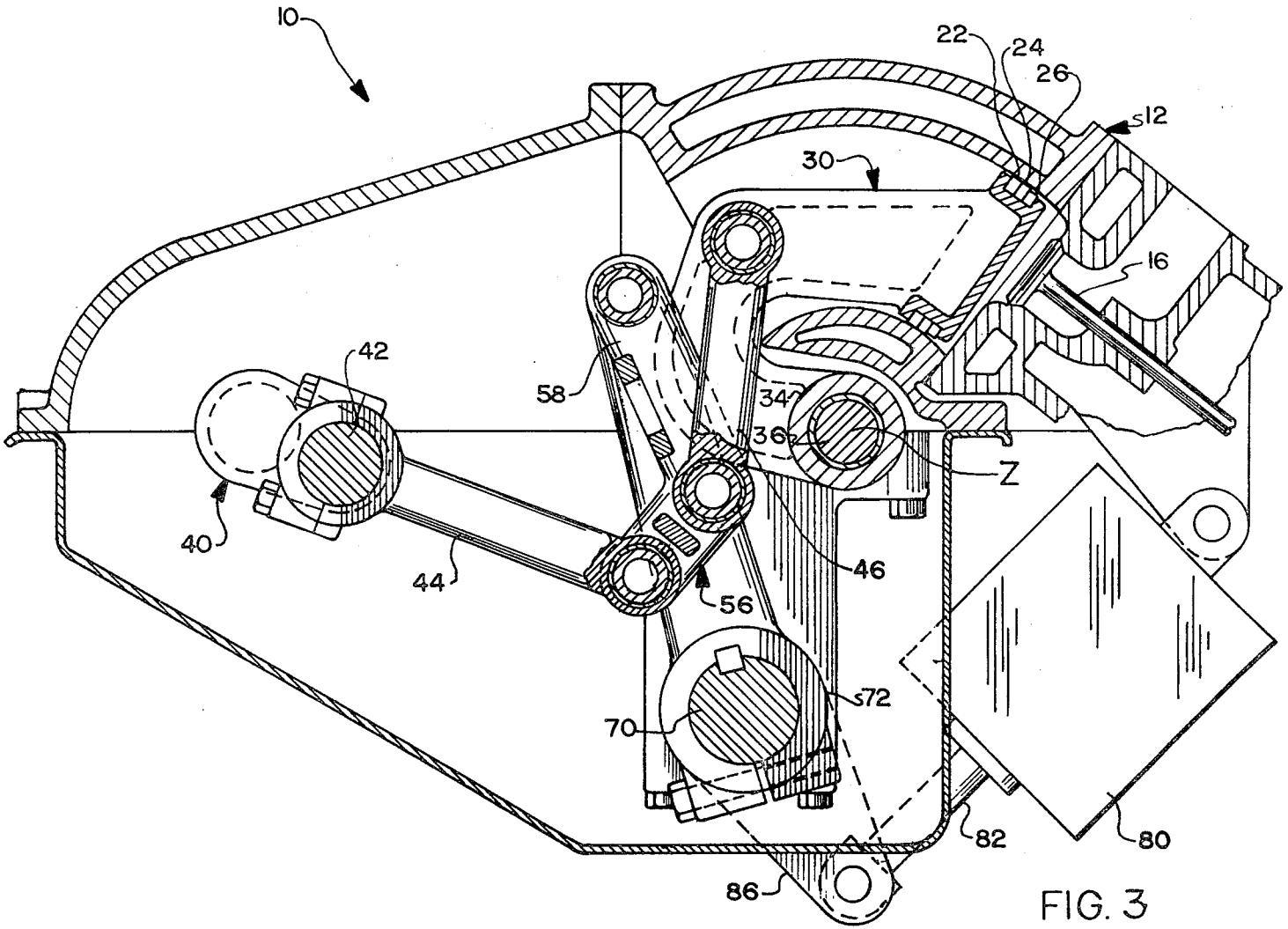
FIG. 3 is a vertical section, like FIG. 1, but with the piston moving through approximately one-third of the stroke of its cylinder and being shown at the top of its stroke.
Figure 4:
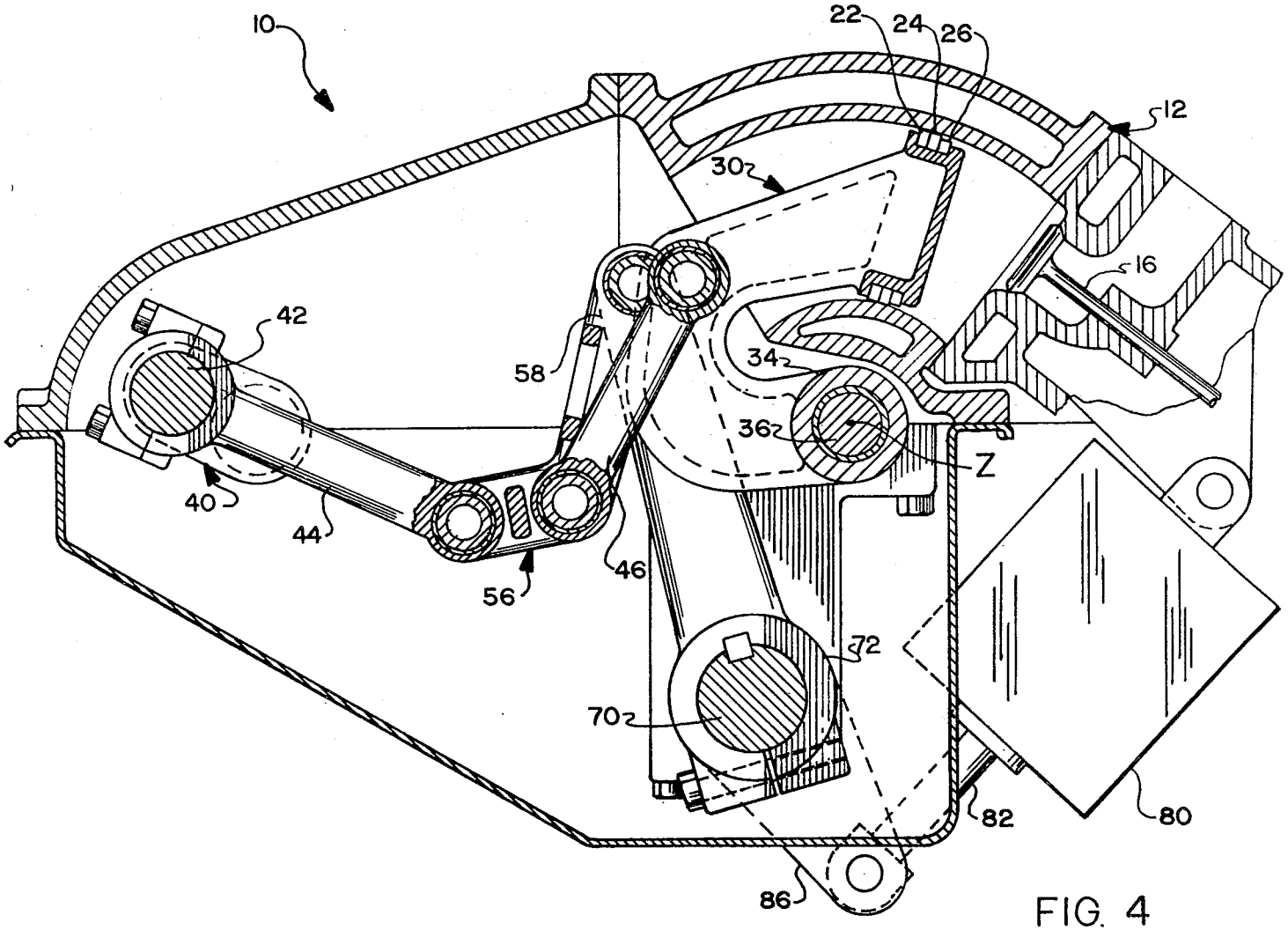
FIG. 4 is a section, like FIG. 3, but with the piston being shown at the bottom of its stroke.

In order to correlate the lengths of stroke of the piston 40 in its cylinder, and to provide a substantially constant compression ratio in the engine for the fuel-air mix supplied thereto for the various operating conditions of the engine, special control means is provided for correlating the stroke length of the piston with the power supply to the engine. Thus a regulatory or control shaft 70 is shown in the drawings and this shaft 70 is suitably journaled in the engine block and it is parallel to the crank shaft and to the mounting shaft 36 for the piston rod 30. The regulatory shaft has a first control arm 72 extending therefrom and such arm 72 pivotally engages a free end of the connector 56 by suitable shaft 74 carried by such connector and any desired bearing means associated therewith. Thus by arcuate movement of the shaft 70 and its control arm 72, the effective operative stroke of the piston can be varied appreciably as the piston is operably coupled to such arm 72 by control members 56 and 46 that connect to piston rod 30. FIGS. 1 and 2 show the position of this regulatory arm 72 where the full stroke of the piston in its cylinder under maximum power output conditions is obtained. However, when one wants to reduce the length of stroke of the piston in its cylinder, then the shaft 70 must move through an arc and this regulatory arm takes a different position, i.e. that as shown in FIGS. 3 and 4 for obtaining a $\frac{1}{3}$ stroke piston in its cylinder.

Control of this regulatory shaft 70 is obtained in correlation with the fuel supply to the engine. Hence, I have provided control means such as a servo mechanism as indicated at 80 that is suitably connected to and operated by the accelerator of the engine whereby such servo reflects and shows full throttle, medium throttle, low throttle conditions, etc., and the position of the output rod or shaft 82, from this servo means, in turn accurately reflects the fuel supply to the engine. This output rod 82 pivotally connects at 84 to a second control arm 86 that is suitably fixedly secured to the regulatory shaft 70 whereby on movement of the output shaft 82 of the servo means, the control arm 86 will change the arcuate position of the shaft 70 from the position as shown, for example, in FIG. 3 to or from the position shown in FIG. 1, and corresponding changes can be made for other positions of the accelerator and the fuel supply for the engne 10. Hence the arcuate movement of the regulatory shaft will control the length of the piston stroke to obtain substantially a constant fuel compression ratio at all times.

Figure 5:
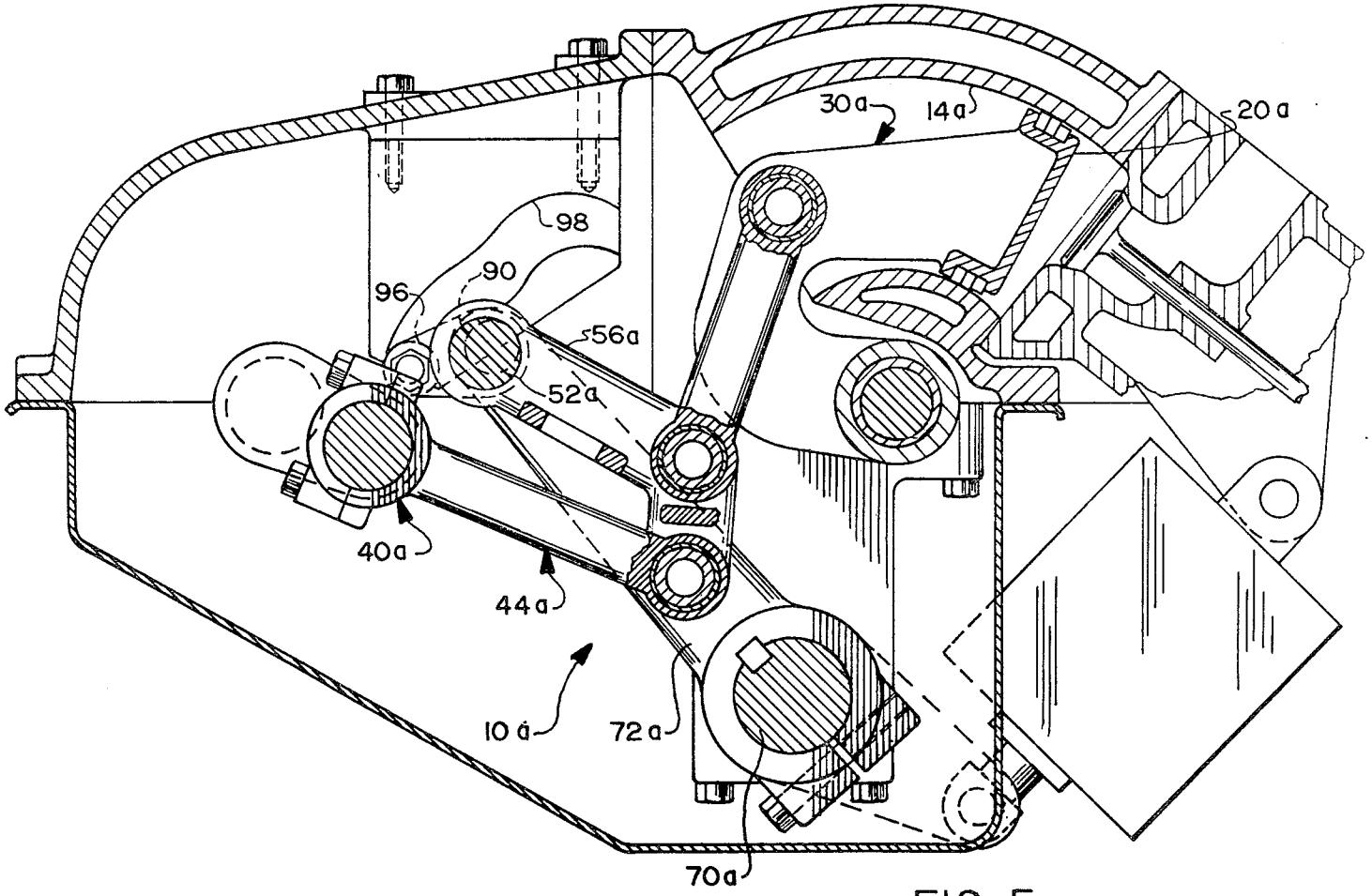
FIG. 5 is a vertical section of a modified internal combustion engine of invention, with a control means provided therein for theoretically constant compression ratios at any speed.

A modified combustion engine **10*a* is shown in FIG. 5 and this includes the same general parts as shown in FIG. 10*a*, but in this instance, the engine 10*a* is shown to have equivalent parts to the engine and include a cylinder 14*a*, a piston 20*a*, a piston rod 30*a*, and output crankshaft 40*a*, a con-connecting rod 44*a*, and an L-shaped connector 56*a*. Likewise, a regulatory shaft 70*a* and arm 72*a*** extending therefrom, are provided.

Figure 6:
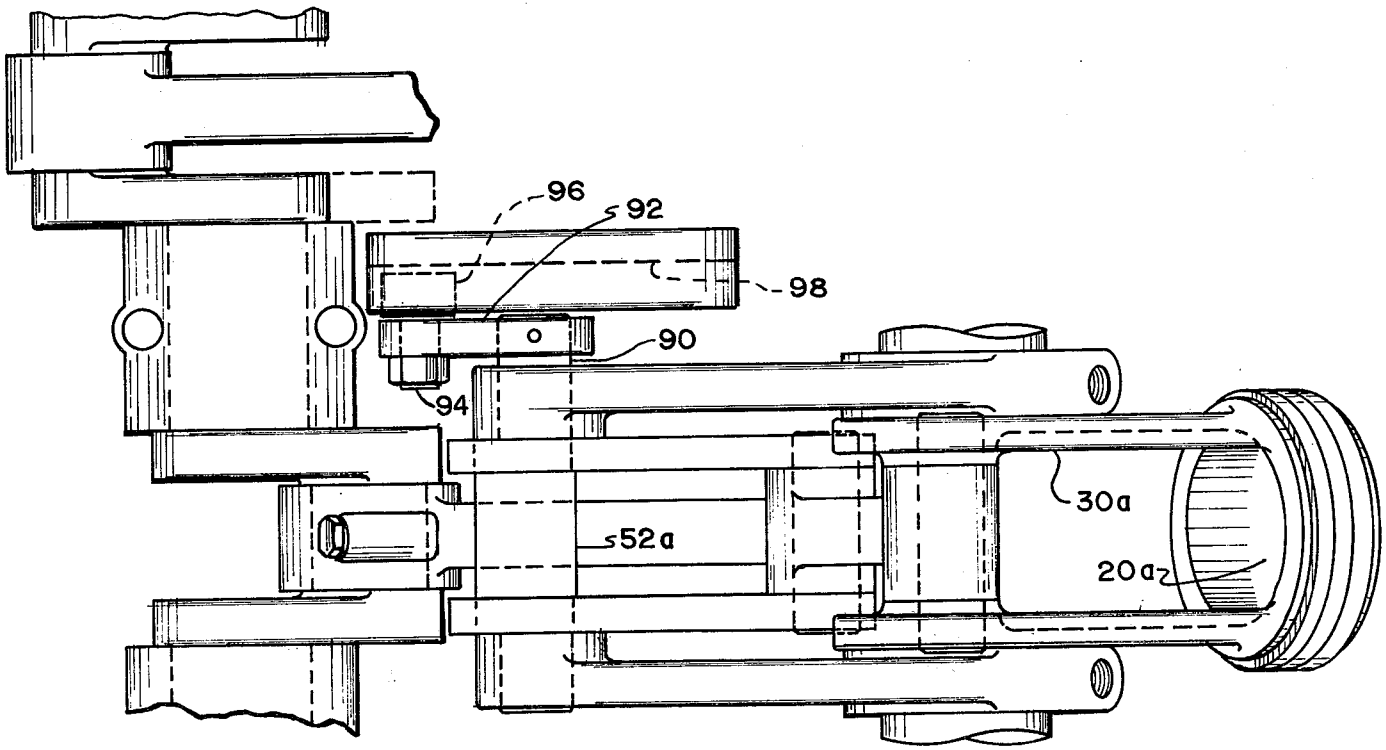
FIG. 6 is a plan view of the engine of FIG. 5; and, compression ratio obtained by the combustion engine of FIGS. 1 through 4.

In this particular instance, almost a perfectly constant compression ratio can be obtained in the engine **10*a* by the addition of a control cam to limit movement of the free end of a connector, or connecting link 56*a*. In FIGS. 5 and 6, the shaft 52*a* for the L-shaped connector 56*a* has an eccentric pin 90 formed at one end thereof. This pin has a short cam arm 92 secured thereto and extending radially therefrom, and terminating in a support shaft 94 that positioned a roller cam 96 thereon. This roller cam 96 in turn engages with a cam track 98 that is suitably formed in a wall of the engine block or in equivalent means positioned in the combustion engine 10 as shown in FIG. 5. Such cam track 98 aids in positioning the links and members connecting the piston rod 30*a* to the connecting rod 44*a* so as to maintain the stroke of the piston in its cylinder and effective length thereof to be of such a nature to produce substantially constant fuel pressure ratios for all fuel supply conditions. Hence the stroke length of this piston 20*a*** corresponds to the setting of the accelerator for the motor and the fuel volume supply to the engine.

It should be understood, that with the exception of the pin 90 and associated cam and cam track means, the parts shown in FIG. 6 completely correspond to the engine parts shown in FIGS. 1–4.

It also will be noted that this pin 90 is slightly eccentric to the center line of the shaft **52*a*** for the L-shaped connector. By this further modification in the linkage connecting the movable members of the engine and controlling the piston stroke length, the required compression ratio can be maintained constant.

Figure 7:
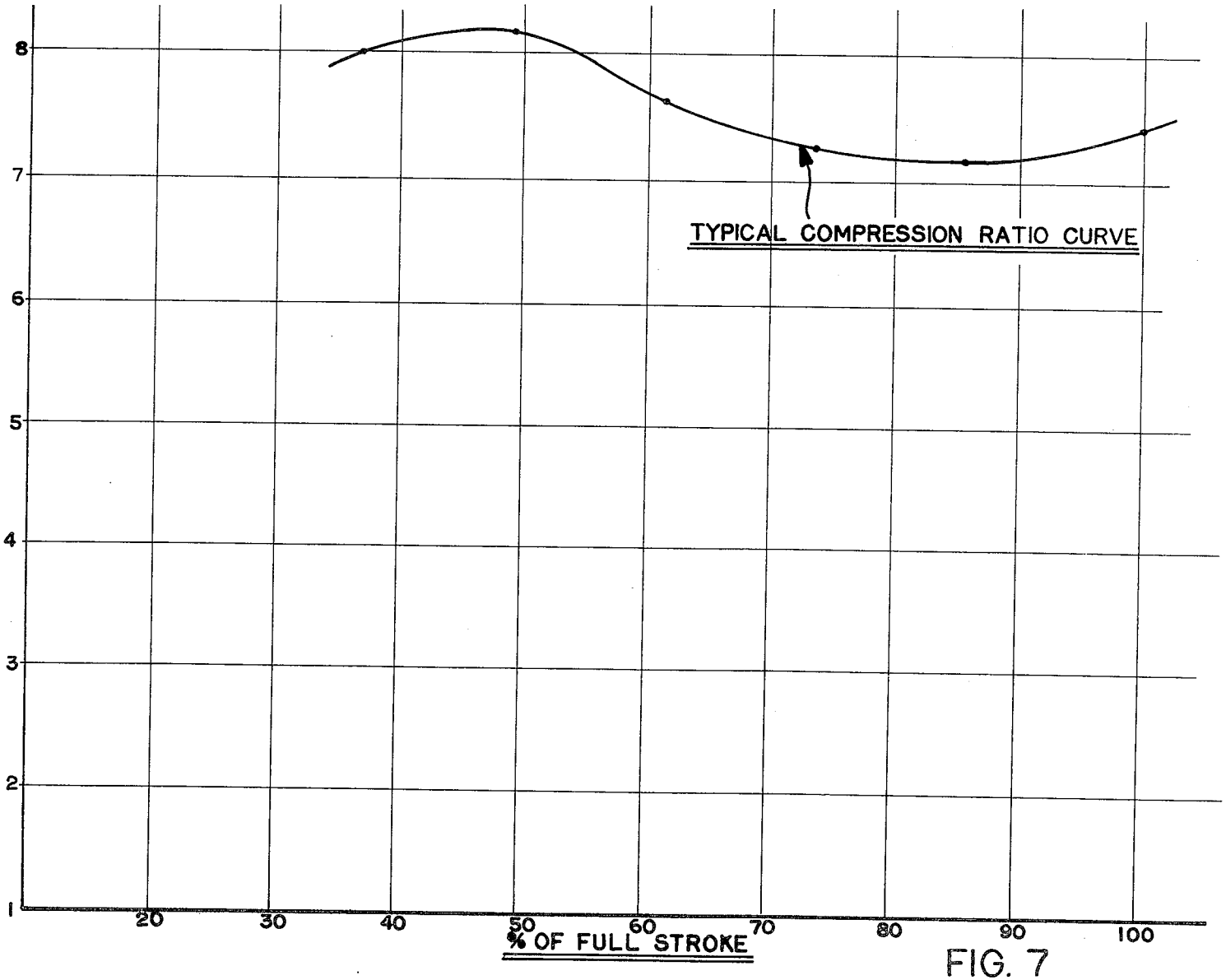
FIG. 7 shows a compression ratio curve obtained in the engine of the invention.

Reference also is made to the graph of FIG. 7 which shows typical compression ratio curve obtained in the engine of the invention and wherein the compression in the combustion cylinder is at or near 8 at nearly all times and only reduces down to slightly above 7 for some portions of about the full stroke of the piston in its arcuate cylinder.

While one complete embodiment of the invention has been disclosed herein, it will be appreciated that modification of this particular embodiment of the invention may be resorted to without departing from the scope of the invention.

What is claimed is:

1. In an internal combustion engine, a crankshaft having a fixed rotary axis, a connecting rod engaging said crankshaft, an engine block means including an arcuately shaped cylinder, valve and combustion material supply means connected to said cylinder, a piston positioned in said cylinder for reciprocation therein, a piston rod positioning said piston, a regulatory shaft positioned parallel to said crankshaft on a second fixed rotary axis, a mounting shaft for said piston rod, and link means pivotally interconnecting said piston rod to said connecting rod and operatively connecting to said regulatory shaft to control the length of stroke of said piston dependent upon the operational condition of said engine, wherein an accelerator is provided to control engine speed, and means operatively connect said regulatory shaft to the accelerator controlling the engine to move said regulatory shaft arcuately with changes in the setting of said accelerator and reduce the length of piston stroke with less fuel supply to the engine.

2. In internal combustion engine, a crankshaft, an engine block means including a toroidal shaped cylinder, valve and combustion material supply means connected to said cylinder, a piston positioned in said cylinder for arcuate reciprocation therein, a piston rod, means including a piston rod shaft engaging said piston rod for pivotally positioning said piston for movement about the center axis of the toroid defining said cylinder, a connecting rod for said crankshaft, articulated link means pivotally connecting said piston rod to said connecting rod, piston rings on said piston and forming the only contact between said piston and said cylinder to reduce operational friction therebetween, and a regulatory shaft being positioned within said engine, parallel to said crankshaft and with a connector link non-rotatably connected to and extending from said regulatory shaft, and said articulated link means also operatively connect to said regulatory shaft via said connector link, an accelerator for control of said engine, and means operatively connect said regulatory shaft to the accelerator controlling the engine to rotate said regulatory shaft through a controlled arc with changes in the setting of said accelerator and reduce the length of piston stroke with reduced fuel supply to the engine to maintain substantially uniform compression in the cylinder at all times.

3. In an internal combustion engine, a crankshaft, an engine block means including an arcuately shaped cylinder, valve and combustion material supply means connected to said cylinder, a piston positioned in said cylinder for reciprocation therein, a piston rod and piston rod shaft pivotally positioning said piston, a regulatory shaft positioned parallel to said crankshaft and a first connector arm non-rotatably connected to and extending from said regulatory shaft, a control means secured to said regulatory shaft to move it arcuately to control the length of stroke of said piston, said control means being positioned externally of said engine to vary the length of the piston stroke dependent upon the fuel supply by arcuate movement of said regulatory shaft to obtain a substantially uniform fuel compression at all engine loads, a connecting rod engaging said crankshaft, a connecting link connecting a free end of said connecting rod to a free end of said first connector arm, and, a coupling link operatively extending from said connecting link to said piston rods to couple said piston to said crankshaft.

4. In an internal combustion engine as in claim 3, where said crankshaft and regulatory shafts are positioned on fixed rotary axes, said piston rod shaft has its axis within the confines of said cylinder at the upper end of the piston stroke.

5. In an internal combustion engine as in claim 3, where said coupling link engages said connecting link intermediate the ends thereof.

6. In an internal combustion engine as in claim 3, where said connector link has a cam and cam track means operatively secured thereto adjacent the portion thereof connecting to said first connector arm.

* * * * *